US011732992B1

(12) United States Patent
Ellinghuysen

(10) Patent No.: US 11,732,992 B1
(45) Date of Patent: Aug. 22, 2023

(54) WEAPON HOLDER FOR HUNTING BLIND

(71) Applicant: Mark Ellinghuysen, Winona, MN (US)

(72) Inventor: Mark Ellinghuysen, Winona, MN (US)

(73) Assignee: Mark Ellinghuysen, Winona, MN (US)

( * ) Notice: Subject to any disclaimer, the term of this patent is extended or adjusted under 35 U.S.C. 154(b) by 0 days.

(21) Appl. No.: 17/691,230

(22) Filed: Mar. 10, 2022

(51) Int. Cl.
*F41A 23/18* (2006.01)
*F41B 5/14* (2006.01)

(52) U.S. Cl.
CPC ..... *F41A 23/18* (2013.01); *F41B 5/1453* (2013.01)

(58) Field of Classification Search
CPC ..... F41A 23/04; F41A 23/18; F41B 5/1453
See application file for complete search history.

(56) References Cited

U.S. PATENT DOCUMENTS 219,921 A 9/1879 Davis
350,523 A 10/1886 Bodley
554,252 A * 2/1896 Falk ..... F41A 23/18 211/64
586,238 A 7/1897 King
1,206,655 A 11/1916 Belcher
2,321,018 A * 6/1943 Dowd ..... A47B 81/005 211/64
2,488,664 A 11/1949 Gruber
2,612,336 A 9/1952 Tuttle
2,911,173 A 11/1959 Deppe
3,116,808 A 1/1964 Riley
3,209,442 A 10/1965 Watson
3,286,967 A * 11/1966 Ferrell ..... A47B 81/005 24/698.2
3,465,928 A 9/1969 Osterholm
3,485,320 A 12/1969 Jones
3,876,078 A * 4/1975 Gomes ..... A47B 81/005 248/231.71
3,910,382 A * 10/1975 Justice ..... F41A 23/18 187/401
4,007,554 A * 2/1977 Helmstadter ..... F41A 23/06 42/94
4,026,057 A * 5/1977 Cady ..... F41A 23/16 42/94
4,089,423 A * 5/1978 Gorham ..... F41A 23/18 248/156
4,144,971 A * 3/1979 Balibrea ..... F41A 23/18 248/156
4,146,204 A 3/1979 Thalenfeld
4,286,717 A 9/1981 Liesinger
4,474,296 A 10/1984 Hartman
4,519,566 A 5/1985 Manzi
4,542,873 A 9/1985 Matherly et al.
4,696,461 A 9/1987 Zelinski
4,729,363 A 3/1988 Skyba
4,799,324 A * 1/1989 Nodo ..... F41A 23/16 42/94

(Continued)

*Primary Examiner* — Derrick R Morgan
(74) *Attorney, Agent, or Firm* — Foley & Lardner LLP

(57) ABSTRACT

A weapon holder includes a stock support, a limb, and a fore end support. The stock support defines a recessed area sized to receive a stock of a weapon therein. The limb is coupled to a first end of the stock support and extends away from the stock support at an angle relative to the stock support. The stock support and the limb together define a weapon receiving area. The limb includes an offset portion that extends away from the weapon receiving area. The fore end support is coupled to a distal end of the limb.

18 Claims, 6 Drawing Sheets

(56) References Cited

U.S. PATENT DOCUMENTS 4,858,359 A * 8/1989 Danz ..... F41A 23/02 42/94
4,880,192 A 11/1989 Vom Braucke et al.
4,909,467 A 3/1990 Shan-Pao
4,915,273 A * 4/1990 Allen ..... B62J 11/00 224/462
4,936,531 A 6/1990 Bauser
4,937,965 A * 7/1990 Narvaez ..... F41A 23/02 42/94
5,009,283 A 4/1991 Prejean
5,012,606 A * 5/1991 McNulty, Jr. ..... A47B 81/005 361/194
5,039,052 A 8/1991 Carafice
5,063,678 A 11/1991 Simo
5,183,231 A 2/1993 Pellerin
5,186,276 A 2/1993 Craig
5,297,766 A 3/1994 Hoffman
5,310,150 A 5/1994 Fecko
5,411,191 A 5/1995 Bunn, Jr.
5,482,241 A 1/1996 Oglesby
5,595,333 A * 1/1997 Boston ..... B60R 7/14 224/532
5,619,981 A 4/1997 Breedlove
5,666,757 A * 9/1997 Helmstadter ..... F41A 23/04 42/94
5,680,939 A * 10/1997 Oliver ..... A47B 81/005 248/161
5,769,372 A 6/1998 Klosterman
5,775,658 A 7/1998 Englehardt
5,791,499 A * 8/1998 Zebbedies ..... B60R 7/14 248/176.1
5,819,462 A * 10/1998 Dockery ..... A47B 81/005 211/64
5,913,667 A * 6/1999 Smilee ..... F41A 23/06 42/94
5,913,668 A * 6/1999 Messer ..... F41A 23/14 42/94
5,967,475 A 10/1999 Johnson
6,035,572 A * 3/2000 Goode, Jr. ..... F41A 23/04 42/94
6,035,842 A 3/2000 Bradley
6,202,665 B1 * 3/2001 O'Hare ..... A01M 31/025 135/901
6,269,578 B1 * 8/2001 Callegari ..... F41A 23/02 297/172
6,336,520 B1 1/2002 Amacker
6,457,685 B1 * 10/2002 Taylor ..... F41A 23/18 124/44.5
6,488,018 B2 12/2002 Hulm
6,502,566 B1 1/2003 Achkar
6,571,916 B1 6/2003 Swanson
6,591,823 B1 7/2003 Keller
6,595,325 B2 7/2003 Ulrich
6,663,059 B1 12/2003 Warren
6,763,820 B1 7/2004 Pinto, Jr.
6,935,065 B1 * 8/2005 Oliver ..... F41A 23/04 248/161
6,986,446 B2 1/2006 Murray et al.
7,124,530 B1 * 10/2006 Clark ..... F41A 23/18 42/90
7,156,086 B1 1/2007 Wells
7,163,183 B2 1/2007 Sutherland et al.
7,406,794 B1 * 8/2008 Pope, Jr. ..... F41A 23/16 89/37.04
7,546,990 B1 6/2009 McGuire
7,631,754 B1 12/2009 Fickett
8,016,134 B1 9/2011 Templin et al.
8,061,341 B2 11/2011 Hudkins
8,109,028 B2 * 2/2012 Roberts ..... F41A 25/04 89/37.04
8,231,095 B2 7/2012 Bean
D676,515 S 2/2013 Mosteller
8,424,645 B2 4/2013 Schlipf
8,439,026 B1 5/2013 Kilian
8,444,034 B2 * 5/2013 Bennett ..... B60R 7/14 224/544
8,549,786 B1 * 10/2013 Griffith ..... F41A 23/14 42/94
8,656,626 B1 * 2/2014 McCamley ..... A47B 81/00 248/176.1
8,678,206 B2 3/2014 Kubiniec
8,733,227 B1 * 5/2014 Ridgeway ..... F41A 23/18 89/37.04
8,910,560 B2 * 12/2014 Irwin ..... B60R 7/14 42/70.11
9,140,512 B2 * 9/2015 Witchel ..... F41A 25/00
9,585,379 B2 3/2017 Dorrity
9,938,734 B1 4/2018 Garis
10,288,216 B1 5/2019 Amanze et al.
10,302,386 B2 * 5/2019 Heninger ..... F41C 9/085
10,412,954 B1 9/2019 Ellinghuysen
10,757,930 B2 9/2020 Ellinghuysen
11,110,867 B2 * 9/2021 Franklin ..... A47F 7/0028
2002/0078988 A1 6/2002 Valpredo
2003/0168285 A1 9/2003 Eastman, II
2004/0149867 A1 * 8/2004 Johnson ..... F41B 5/1453 248/146
2004/0237372 A1 * 12/2004 Frye ..... F41A 23/16 89/37.04
2005/0000141 A1 * 1/2005 Cauley ..... F41A 23/16 42/94
2005/0109891 A1 5/2005 McCuskey et al.
2005/0167378 A1 8/2005 Scott, Jr.
2006/0230664 A1 * 10/2006 Eddins ..... F41C 27/22 42/94
2006/0248775 A1 * 11/2006 Wade ..... F41A 23/34 89/37.04
2007/0170129 A1 * 7/2007 Punzel ..... F41A 23/18 211/64
2009/0183415 A1 * 7/2009 Boord ..... F41A 23/10 42/94
2009/0249675 A1 * 10/2009 Cauley ..... F41A 29/00 42/94
2010/0065701 A1 3/2010 Fletcher
2011/0308887 A1 12/2011 Johnson
2012/0104196 A1 5/2012 Regina
2012/0168249 A1 7/2012 Furseth et al.
2012/0174461 A1 * 7/2012 Potterfield ..... F41A 23/16 29/525.01
2012/0186125 A1 * 7/2012 Werner ..... F41A 23/18 42/94
2012/0222344 A1 * 9/2012 Werner ..... F41A 23/16 42/94
2014/0077432 A1 3/2014 Lee et al.
2014/0190767 A1 7/2014 Wheelington
2014/0237882 A1 * 8/2014 Banes ..... F41A 23/02 42/94
2014/0311828 A1 10/2014 Bassett et al.
2015/0069103 A1 * 3/2015 Fife ..... B60R 7/14 224/555
2016/0128317 A1 5/2016 Gerry
2016/0298922 A1 * 10/2016 Duncan ..... F41A 25/10
2017/0072864 A1 * 3/2017 Fife ..... B60R 7/043
2017/0115087 A1 * 4/2017 Di Carlo ..... B60R 7/14
2017/0265454 A1 9/2017 Kramer
2018/0110335 A1 4/2018 O'Hagan
2018/0170268 A1 * 6/2018 Fisher ..... B60R 7/14
2019/0055782 A1 2/2019 Infalt et al.
2019/0104728 A1 4/2019 Howell, Jr.
2020/0208933 A1 * 7/2020 Wynalda, Jr. ..... F41A 23/06
2021/0041202 A1 * 2/2021 Cauley, Jr. ..... F41A 23/16
2021/0107410 A1 * 4/2021 Franklin ..... B60R 7/14

* cited by examiner

WEAPON HOLDER FOR HUNTING BLIND

TECHNOLOGY

The present technology relates generally to the field of weapon support systems for hunting blinds. More specifically, this technology relates to an adjustable weapon holder.

SUMMARY

An embodiment of the present disclosure relates to a weapon holder. The weapon holder includes a stock support, a limb, and a fore end support. The stock support defines a recessed area sized to receive a stock of a weapon therein. The limb is coupled to a first end of the stock support and extends away from the stock support at an angle relative to the stock support. The stock support and the limb together define a weapon receiving area. The limb includes an offset portion that extends away from the weapon receiving area. The fore end support is coupled to a distal end of the limb.

Another embodiment of the present disclosure relates to a weapon holder. The weapon holder includes a stock support, a limb, and a fore end support. The stock support defines a recessed area sized to receive a stock of a weapon therein. The limb is coupled to a first end of the stock support and extends away from the stock support at an angle relative to the stock support. The limb includes a first linear portion and an arcuate extension engaged with and extending away from the first linear portion. The fore end support is coupled to a distal end of the limb.

Another embodiment of the present disclosure relates to a blind. The blind includes a frame and a weapon holder. The weapon holder includes a stock support, a limb, and a fore end support. The stock support defines a recessed area sized to receive a stock of a weapon therein. The limb is coupled to a first end of the stock support and extends away from the stock support at an angle relative to the stock support. The stock support and the limb together define a weapon receiving area. The limb includes an offset portion that extends away from the weapon receiving area. The fore end support is coupled to a distal end of the limb.

DETAILED DESCRIPTION

Figure 1A:
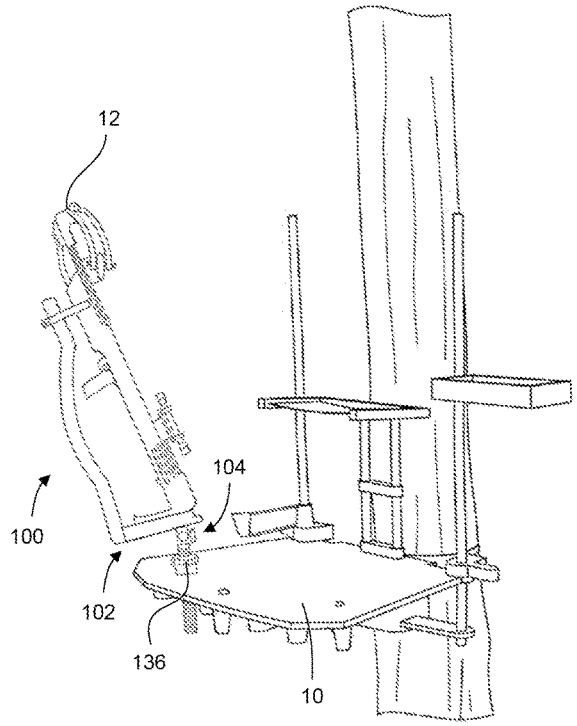
FIG. 1A is a perspective view of a game blind including a weapon holder with a cross bow positioned in the weapon holder, according to an illustrative embodiment.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s).

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

Existing weapon holders for use in hunting and/or other recreational activities often rely on hooks or racks to support the weapon. The weapon is placed on top of the hooks, which support the weapon under the force of gravity. The hooks need to be placed far enough apart to support both ends of the weapon and to reduce the risk of the weapon becoming inadvertently dislodged from the holder. However, such weapon holders may be cumbersome to use and may only support the weapon in a single position. Additionally, adjusting the position of the weapon holder may require removal and reinstallation of the hooks or racks.

Referring generally to the Figures, a weapon support system (e.g., holder) is shown that allows a user to quickly store and retrieve their weapon with minimal interference. The system supports the weapon in an upright, ready-to-fire position. When retrieving the weapon, a user simply rotates the stock from its rest position in the holder up to their shoulder without any further manipulation of the weapon. Unlike existing hook-type support systems, the weapon support system of the present disclosure may be adjustable to accommodate weapons of different types, sizes, and shapes. The holder may also be adjusted to manipulate the position of the weapon when placed on the holder, which can improve retrieval times and reduce the amount of manual manipulation required to equip the weapon (thereby increasing user safety during weapon retrieval). The support system also includes a uniquely structured support limb that improves adjustability and to accommodate different weapon types.

Figure 1B:
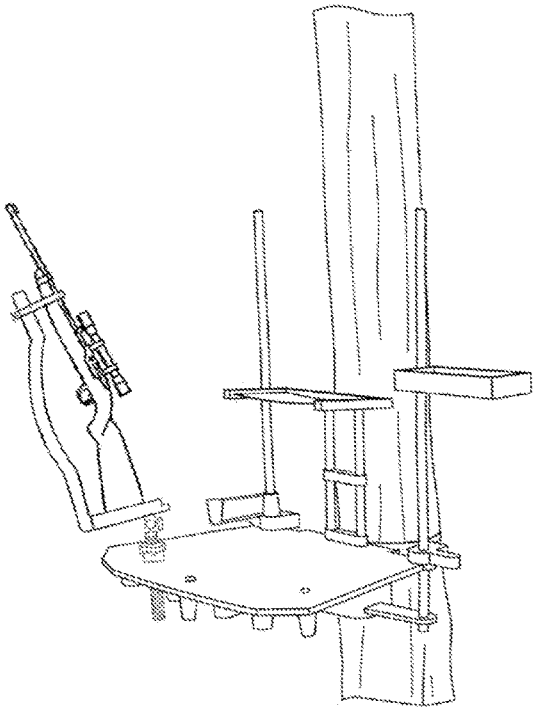
FIG. 1B is a perspective view of the game blind of FIG. 1A with a rifle positioned in the weapon holder.

Referring to FIGS. 1A-1B, a weapon holder 100 configured to support a weapon in a firing position is shown, according to an illustrative embodiment. The weapon holder 100 is configured to support a variety of different types of weapons, including—but not limited to—a crossbow (FIG. 1A) and a rifle (FIG. 1B).

As shown in FIG. 1A, the weapon holder 100 is coupled to a blind 10. The blind 10 may be a game blind, a tree stand (e.g., hunting platform), or another suitable support. In other embodiments, the weapon holder 100 may be coupled to an accessory support structure for a blind and/or directly to a tree or other accessory support structure that is separate from a blind 10. In yet other embodiments, the weapon holder 100 may form a standalone weapon support system that may be secured to the ground or another suitable structure. As shown in FIG. 1, the weapon 12 (e.g., crossbow) is removably coupled to the weapon holder 100 and is supported on the weapon holder 100 under its own weight (e.g., by gravity). In other embodiments, the weapon holder 100 may further include straps, cords, and/or another suitable tether to further secure the weapon 12 onto the weapon holder 100. The weapon holder 100 is configured to facilitate rapid engagement and/or disengagement of the weapon 12 by a user with minimal interaction between the user and the weapon 12 and/or the user and the weapon holder 100.

As shown in FIG. 1A, the weapon holder 100 may be positioned substantially in front of a user such that the user may quickly access the weapon 12. In other embodiments, the weapon holder 100 may be positioned to a side of the user or at another location near the user for ease of access. In some embodiments, the weapon holder 100 is coupled (e.g., mechanically fastened, mounted, etc.) to a helper rail of a blind or platform that at least partially surrounds the user and substantially prevents the user from falling out of the blind 10. In the embodiment of FIG. 1A, the weapon holder 100 supports the weapon 12 in an upright position that allows the user to quickly rotate the butt of the weapon 12 into contact with a user's shoulder (e.g., into a firing position, etc.). The weapon 12 is angled within the weapon holder 100 such that a user rotates the weapon 12 less than 90° in preparation for firing without requiring any further movement or manipulation.

Figure 2:
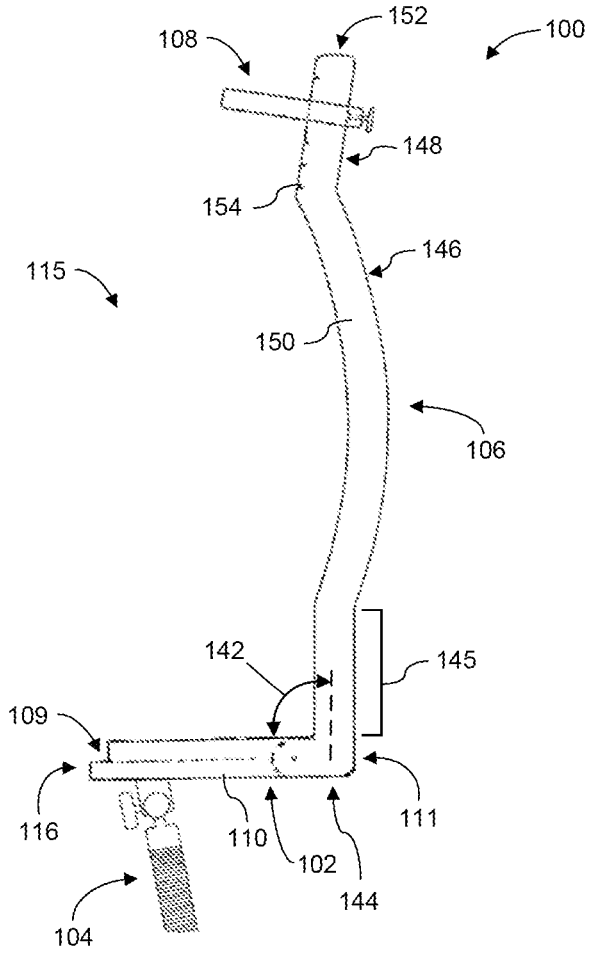
FIG. 2 is a side view of the weapon holder of FIG. 1A.

As shown in FIG. 2, the weapon holder 100 includes a stock support 102 (e.g., stock holder, etc.), a mount 104, a limb 106, and a fore end support 108. In other embodiments, the weapon holder 100 may include additional, fewer, and/or different components. As shown in FIG. 1A, the mount 104 is coupled to the stock support 102 and detachably couples the stock support to the blind 10. In some embodiments, the mount 104, or portions thereof, is also detachably coupled to the stock support 102, and/or detachably or fixedly coupled to another part of the weapon holder 100 (e.g., the limb 106, etc.). As shown in FIG. 2, the limb 106 is rotatably coupled to a first end 111 of the stock support 102 and extends upwardly from the stock support 102 at an angle with respect to the stock support 102. The fore end support 108 is coupled to a distal end of the limb 106 and extends away from the limb 106 in an at least partially parallel orientation with respect to the stock support 102.

Figure 3:
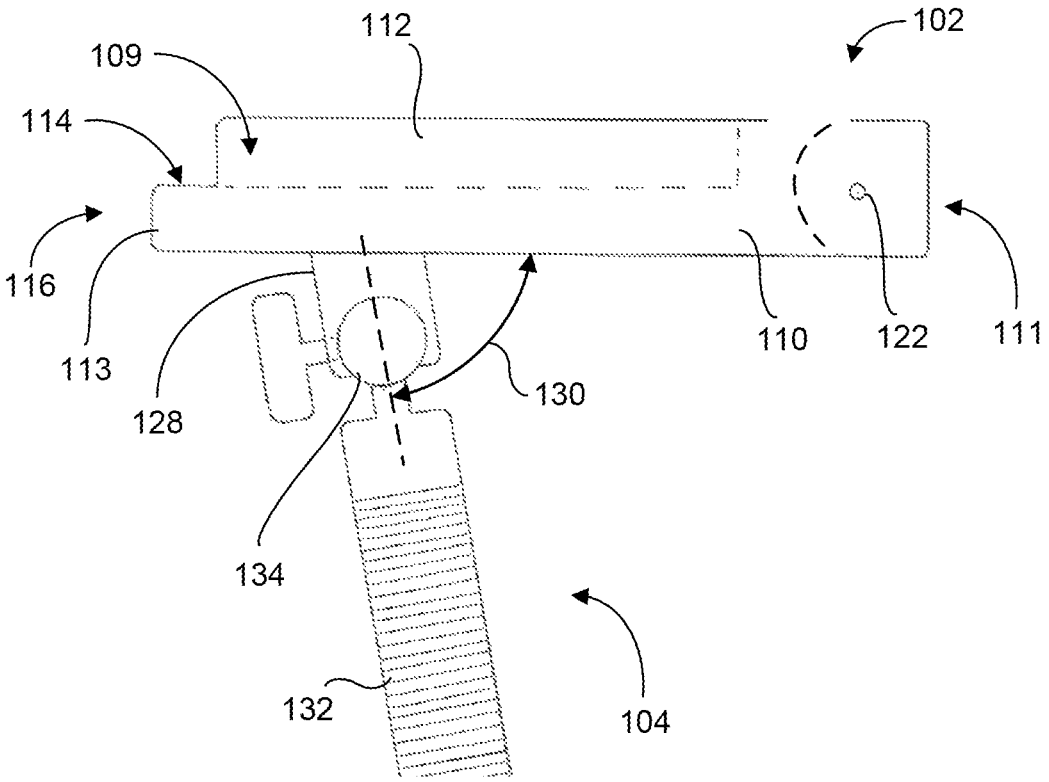
FIG. 3 is a side view of a stock support portion of the weapon holder of FIG. 1A.
Figure 4:
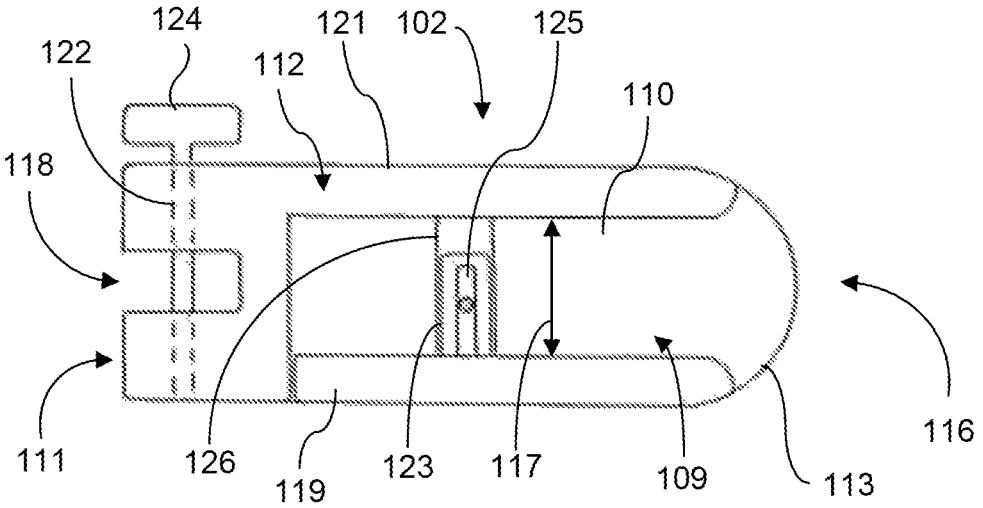
FIG. 4 is a top view of the stock support portion of FIG. 3.

Referring to FIGS. 3-4, a side view and top view, respectively of the stock support 102 are shown. The stock support 102 (e.g., first weapon interface member, etc.) is configured to engage with a stock of a weapon and to at least partially support the weapon in a substantially vertical orientation (e.g., vertically relative to a ground surface and/or the floor area of the blind 10, etc.). For example, the stock support 102 may be structured to receive a butt of a hunting rifle and/or crossbow, as shown in FIG. 1. FIG. 4, the stock support 102 defines a recessed area 109 (e.g., channel, groove, depression, etc.) that is sized to receive a stock (e.g., butt, first end, etc.) of the weapon therein.

As shown in FIG. 4, the stock support 102 includes a base 110 and a pair of substantially parallel walls 112 arranged along a perimeter of the base 110 and extending axially away from an upper side 114 of the base 110. The walls 112 are elongated strips that extend along opposing edges of the base 110. The walls 112 are spaced apart from one another forming a gap 117 therebetween. The recessed area 109 is at least partially defined by the gap 117 and extends from a second end 116 of the stock support 102, opposite to the first end 111, to an intermediate position between the second end 116 and the first end 111. As shown in FIG. 4, the recessed area 109 extends to an area of the base 110 that is proximate to where the limb 106 (see FIG. 2) engages the base 110. As shown in FIG. 4, the recessed area 109 has a rectangular shape when viewed from above the base 110. In other embodiments, the shape of the recessed area 109 may be different.

The parallel walls 112 stabilize the weapon in a substantially perpendicular orientation relative to the base 110 (e.g., an upper surface of the base 110, a lower surface of the recessed area 109, etc.). The base 110 also includes a forward lip 113 that extends forward of the walls 112 (e.g., protrudes beyond a forward end of the walls 112). An upper surface of the forward lip 113 is approximately co-planar with a lower surface of the recessed area 109. As shown in FIG. 4, a forward end of each of the walls 112 is rounded to help guide a stock (e.g., butt, first end, etc.) of the weapon into the recessed area 109.

As shown in FIG. 2, the recessed area 109 faces away from the base 110 (e.g., substantially vertically upward, etc.) and toward a weapon receiving area 115 above the base 110 within which the weapon is positioned when engaged with the weapon holder 100. As shown in FIG. 2, the weapon receiving area 115 is an open area between the stock support 102 and the limb 106 that is at least partially defined by the stock support 102 and the limb 106 (e.g., the stock support 102 and the limb 106 form a portion of an outer perimeter of the weapon receiving area 115).

The stock support 102 is structured to allow a user to readjust the size (e.g., width) of the recessed area 109 to accommodate weapon stocks of various sizes and shapes. In the embodiment of FIG. 4, a first wall 119 of the pair of walls 112 is moveably coupled to the base 110. In particular, the first wall 119 is slidably engaged with the base 110 and is structured to move relative to the base 110 in a direction that is substantially perpendicular to a second wall 121 of the pair of walls 112. The first wall 119 includes a flange 123 (e.g., tab, etc.) engaged with and extending away from the first wall 119 (e.g., in a substantially perpendicular orientation with respect to the first wall 119) and toward the recessed area 109. The flange 123 is disposed at a lower end of the first wall 119 and is received within a substantially rectangular cutout (e.g., slot, etc.) in the base 110 that extends along the lower wall of the recessed area 109, in between the two walls 112. The flange 123 includes an elongated rectangular strip of material (e.g., metal, plastic, etc.) that protrudes off of the first wall 119. However, it should be understood that the shape of the flange 123 may be different in other embodiments. The flange 123 includes an elongated opening 125 that extends through the flange 123. The elongated opening 125 may be sized to receive a fastener (e.g., set screw, screw, bolt, etc.) therein to secure the flange 123 in position within the cutout 126. It will be appreciated that the size, shape, and arrangement of the flange 123 and cutout 126 may be different in other embodiments. Among other benefits, the structure of the flange 123 helps support the first wall 119 in a proper orientation with respect to the base 110 and second wall 121. In other embodiments, another form of adjustable coupling may be used to secure the first wall 119 to the base 110 and/or second wall 121. In yet other embodiments, the first wall 119 may be permanently affixed to the base 110.

As shown in FIG. 4, the base 110 (e.g., stock support 102) further defines a slot 118 extending inward from the first end 111 of the base 110. A depth 120 of the slot 118 may be greater than or equal to a width of the limb 106 at a proximal end of the limb 106 (see FIG. 2) such that the proximal end can be fully received within the slot 118. In other embodiments, the depth of the slot 118 may be less than a width of the proximal end of the limb 106. The limb 106 may protrude away from the first end of the slot 118 (e.g., parallel to a reference line extending between the first end 111 and the second end 116).

The base 110 also defines a through-hole opening 122 that extends through the base 110 and the slot 118. The through-hole opening 122 may be sized to receive a fastener 124 (e.g., bolt, screw, pin, etc.) therein to couple the limb 106 to the stock support 102. The fastener 124 may be configured to bend and/or deflect ears of the base 110 on either side of the slot 118 to pinch and lock the limb 106 in a desired angular position with respect to the base 110. For example, the fastener 124 may be threadably coupled to an ear at a distal end of the fastener 124 (e.g., a free end of a threaded portion of the fastener). Among other benefits, adjusting the position of the limb 106 with respect to the base 110 allows the weapon holder 100 to accommodate a greater variety of weapon types, sizes, and shapes. In other embodiments, the proximal end of the limb 106 may be glued, welded, integrally formed with the base 110 from a single piece of material, or otherwise affixed to the base 110.

Figure 5:
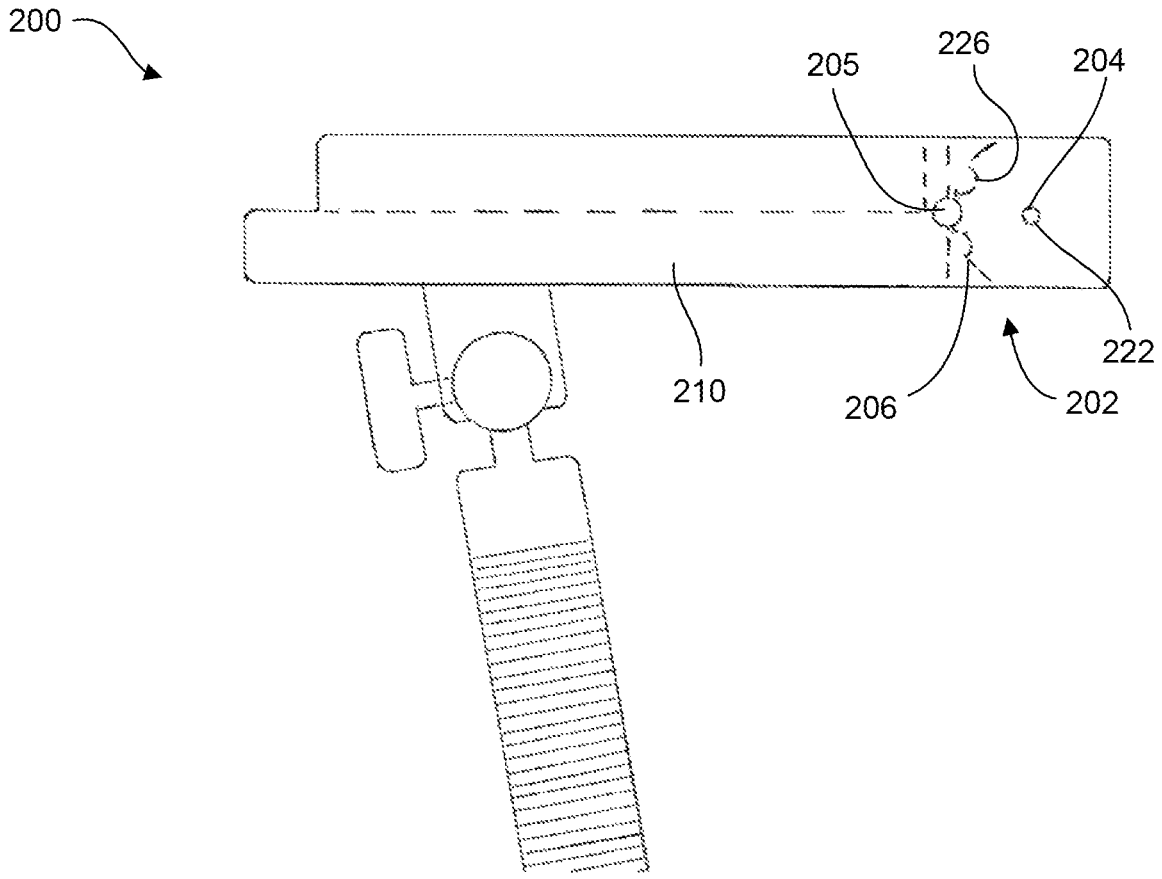
FIG. 5 is a side view of a stock support portion of a weapon holder, according to another illustrative embodiment.
Figure 6:
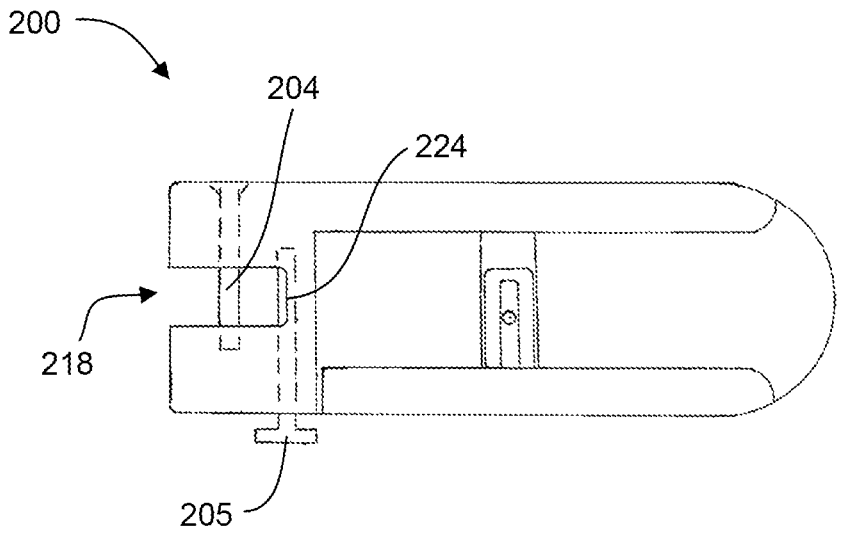
FIG. 6 is a top view of the stock support portion of FIG. 4.

It should be appreciated that the design of the stock support 102 may be different in other embodiments. For example, FIGS. 5-6 show a stock support 200 that further includes a limb adjustment system 202 that is configured to allow adjustment of an angular position of the limb (e.g., limb 106 of FIG. 2) to accommodate different weapon types. As shown in FIG. 6, the limb adjustment system 202 includes a plurality of pins (e.g., fasteners, bolts, etc.) that are structured to engage with both the stock support 200 and the limb 206. As shown in FIG. 5, a first pin 204 extends through a through-hole opening 222 of the base 210 (e.g., through the slot 218 and ears of the base 210) and is configured to rotatably couple the limb 206 to the stock support 200. A second pin 205 extends through the base 210 at an inner end 224 of the slot 218 and is configured to set a rotational position of the limb 206 relative to the base 210. As shown in FIG. 5, the limb 206 includes a plurality of grooves 226 (e.g., channels, etc.) positioned along an outer perimeter of the limb 206 where the limb 106 is inserted into the slot 218 (e.g., a curved outer surface of the limb 206). The grooves 226 are sized to receive the second pin 205 therein to prevent rotation of the limb 206 with respect to the base 210. In some embodiments, the second pin 205 may include a spring loaded mechanism that biases the second pin 205 against the base 210. To operate the limb adjustment system 202, a user simply pulls on an exposed portion of the second pin 205 to pull the second pin 205 away from the base 210 and then rotates the limb 206 into a desired position before releasing the second pin 205. It should be appreciated that the design of the limb adjustment system 202 may be different in various embodiments.

Figure 7:
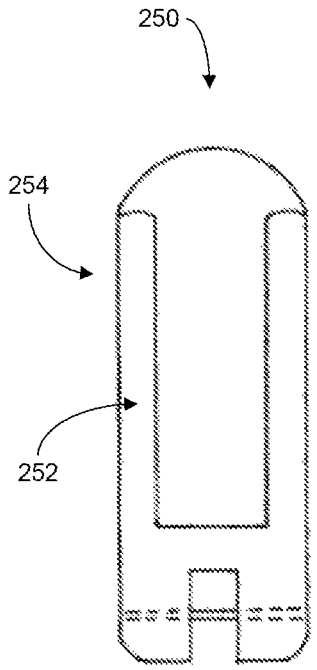
FIG. 7 is a top view of a stock support portion for a weapon holder, according to yet another illustrative embodiment.

FIG. 7 shows yet another illustrative embodiment of a stock support 250 in which the walls 252 are integrally formed with a base 254 of the stock support 250 from a single piece of material (e.g., as a unitary body via injection molding or another suitable manufacturing operation).

Returning to FIG. 2, the mount 104 (e.g., a mounting assembly, etc.) of the weapon holder 100 is configured to detachably couple the weapon holder 100 to the blind 10 and to adjust a position (e.g., a height, an angle, etc.) of the weapon holder 100 relative to the blind 10. As shown in FIG. 1A, a first end (e.g., upper end) of the mount 104 is coupled to the stock support 102. A second end (e.g., lower end) of the mount 104, opposite the first end, is detachably coupled to the blind 10 (e.g., a support structure of the blind 10, a frame, a platform, etc.). As shown in FIG. 1A, the second end is received within an opening of the blind 10, which may include a threaded connector, snap-fit connector, or another form of detachable coupling. In other embodiments, the stock support 102 and/or limb 106 may be directly coupled to the blind 10 without any intervening mount 104.

As shown in FIG. 3, the mount 104 includes a support member 128 (e.g., boss, fitting, etc.) engaged with and extending away from a lower side (e.g., second side) of the base 110 at an oblique angle 130 (e.g., non-perpendicular, non-90°, etc.) with respect to the base 110 (e.g., with respect to a lower surface of the base 110). The support member 128 is coupled to the base 110 proximate to the second end 116 of the base 110 (e.g., approximately half-way between a central position along the base 110 and the second end 116). In at least one embodiment, the base 110 is angled (e.g., tilted, etc.) with respect to the mount 104 such that the first end 111 of the base 110 is positioned vertically below the second end 116 of the base 110 when the mount 104 is coupled to the blind (e.g., when the support member 128 is arranged in a substantially perpendicular orientation with respect to an upper surface of the blind, etc.). In the embodiment of FIG. 3, the support member 128 is a substantially cylindrical protrusion that is pivotally and rotatably coupled to a connecting element 132 of the mount 104 via a ball joint between the support member 128 and the connecting element 132. The support member 128 may be configured to lock the weapon holder 100 at a desired angular position with respect to the blind. For example, the support member 128 may define a pocket that is sized to receive the ball member 134 therein such that the support member 128 wraps around a ball member 134 of the ball joint. The support member 128 may include a fastener that may threadably engage the support member 128 and be positioned to press against the ball member 134 to secure the ball member 134 in position within the support member 128.

As shown in FIG. 3, the ball member 134 may be fixedly coupled to the connecting element 132. The connecting element 132 extends away from the stock support 102 and support member 128 and is structured to detachably couple the weapon holder 100 to the blind support. The connecting element 132 may include a threaded rod, support post, and/or another suitable support element. In the embodiment of FIG. 3, the connecting element 132 is a threaded cylindrical rod that may be inserted into an opening in the blind (e.g., an opening in a platform for the blind). In other embodiments, the connecting element 132 may be threadably coupled to the blind and/or include a lower fitting that is threadably coupled to the blind. The connecting element 132 may also include a cross-hole opening (see cross-hole opening 333 in FIG. 10) at a lower end of the connecting element 132 that extends radially through the connecting element 132. The cross-hole opening 133 may be sized to receive a pin and/or fastener therein to prevent inadvertent removal of the weapon holder 100 from the blind.

Figure 8:
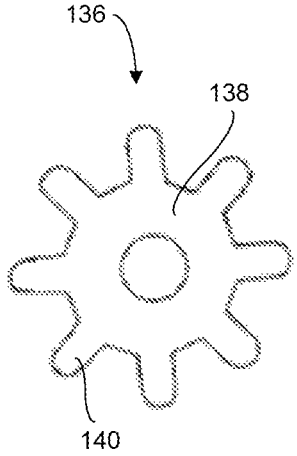
FIG. 8 is a top view of an adjustment member for a mount of a weapon holder, according to an illustrative embodiment.

As shown in FIG. 1A, the mount 104 may further include an adjustment element 136 (e.g., nut, etc.) that is threadably engaged with the connecting element 132. The adjustment element 136 is configured to adjust a height of the weapon holder 100 above the blind 10. As shown in FIG. 1A, the adjustment element 136 may be engaged with an upper surface of the blind and/or a standoff or boss that extends upwardly from the blind 10. As the adjustment element 136 rotates, a height of the connecting element 132 relative to the blind changes. FIG. 8 shows a top view of the adjustment element 136. The adjustment element 136 includes a central body 138 including a threaded opening extending therethrough. The adjustment element 136 also includes a plurality of tabs 140 engaged with and extending radially away from the central body 138. Among other benefits, the tabs 140 allow for hand adjustment of the height of the weapon holder 100 by a user.

Figure 9:
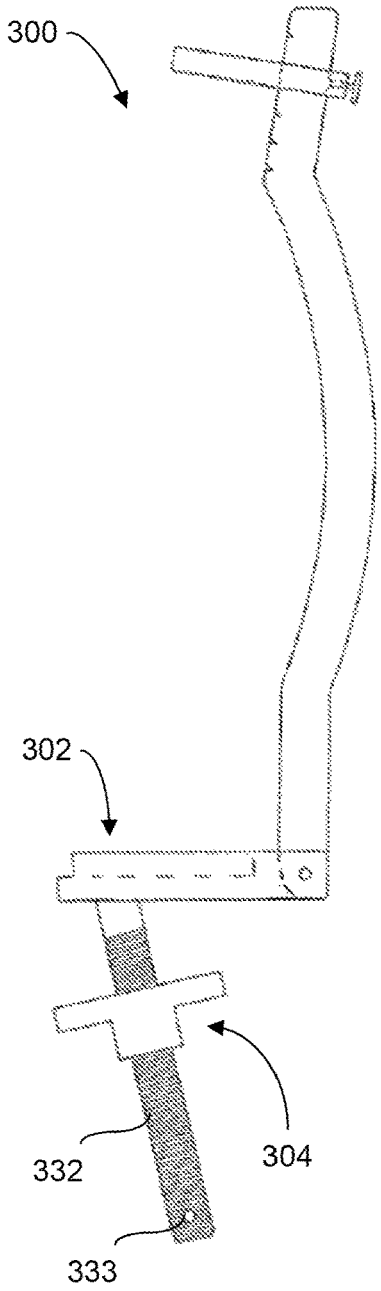
FIG. 9 is a side view of a weapon holder, according to another illustrative embodiment.

It should be appreciated that the design of the mount 104 may be different in other embodiments and that other mounting structures now known or hereinafter developed could be used to attach the weapon holder to a blind. For example, FIG. 9 shows a side view of a weapon holder 300 in which a connecting element 332 of the mount 304 is directly coupled to the stock support 302 without any intervening components. In other embodiments, the mount may further include clips, fasteners, and/or other detachably couplings to simplify installation and removal of the weapon holder. In yet other embodiments, the mount 104 may be coupled to another component of the weapon holder 100 (e.g., the limb 106, etc.).

Returning back to FIG. 2, the limb 106 (e.g., fore end support arm, etc.) of the weapon holder 100 is structured to support the fore end portion of a weapon (e.g., an upper portion of the weapon away from the stock, a fore stock, etc.) in an upright or an at least partially upright position within the weapon holder 100. The limb 106 is also structured to accommodate different grip configurations for various different types of weapons. The limb 106 may also be adjustable to accommodate different weapon types, to manipulate a position of the weapon when placed in the weapon holder 100, and to improve support of the weapon when placed in the weapon holder 100.

As shown in FIG. 2, the limb 106 is rotatably coupled to the first end of the stock support 102 and extends away from the stock support 102 at an angle 142 relative to the stock support 102. A proximal end 144 (e.g., lower end as shown in FIG. 2, first end, etc.) of the limb 106 is coupled to the stock support 102 by a fastener (e.g., bolt, screw, toggle, pin, etc.) that extends through the base 110 of the stock support 102 and the proximal end 144. The proximal end 144 may be rounded to allow rotation of the limb 106 with respect to the stock support 102. In other embodiments, the proximal end 144 may be a polygon with straight edges (e.g., an octagon, etc.) that at least partially support the limb 106 in different angular positions with respect to the stock support 102 when the limb 106 is engaged with the stock support 102 (e.g., when the proximal end 144 of the limb 106 is engaged with an inner end of the slot 118 (see FIG. 4).

In some embodiments, the fastener may be threadably coupled to the base 110 of the stock support 102 and may be structured to secure the limb 106 in a desired rotational position with respect to the stock support 102. In yet other embodiments, another suitable adjustment mechanism (e.g., a second pin that may be inserted through the base 110 of the stock support 102 and the limb 106 in various different angular positions as described with reference to FIGS. 5-6, etc.) may be used to secure the limb 106 in a desired rotational position. Adjusting the angular position of the limb 106 with respect to the stock support 102 allows the user to tilt the weapon, for example, to level the stock of the weapon in the stock support 102 (e.g., to improve the stability of the weapon in the weapon holder) or to angle the weapon to improve retrieval times (e.g., based on a height or position of the user with respect to the weapon holder 100, etc.). In yet other embodiments, the limb 106 may be fixedly coupled to the stock support 102 and extend away from the stock support 102 in a substantially perpendicular orientation relative to the stock support 102 (e.g., an upper surface of the stock support 102), or at another suitable angle relative to the stock support 102.

As shown in FIG. 2, the limb 106 includes a first linear portion 145, a offset portion 146 (e.g., curved portion, bowed portion, stooped portion, etc.) engaged with and extending away from the first linear portion 145, and a second linear portion 148 engaged with and extending away from a distal end of the offset portion 146. The first linear portion 145 and the second linear portion 148 are each straight sections of the limb 106 shown in FIG. 2. The first linear portion 145 is coupled to the stock support 102 and extends between the stock support 102 and the offset portion 146. In other embodiments, the limb 106 may only include a single linear portion coupled to the offset portion 146. In such an embodiment, the offset portion 146 may be directly coupled to the stock support 102 and the single linear portion may be coupled to a distal end of the offset portion 146.

Figure 10:
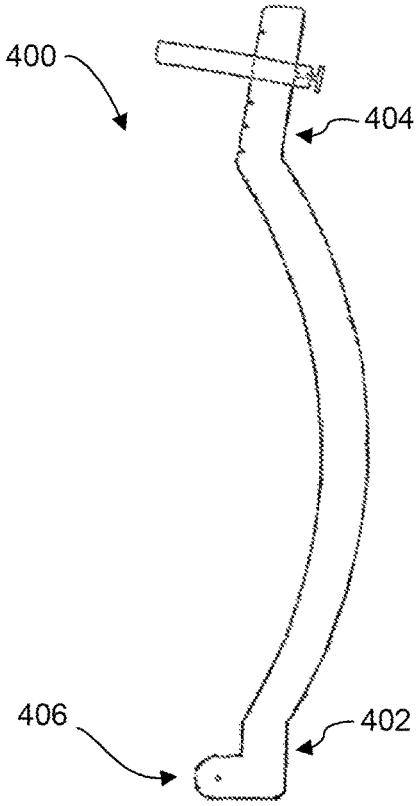
FIG. 10 is a side view of a limb of a weapon holder, according to an illustrative embodiment.

It should be appreciated that a length of the first linear portion 145, the offset portion 146, and/or the second linear portion 148 may be different in various embodiments. For example, FIG. 10 shows another embodiment of a limb 400 in which the first linear portion 402 has a smaller length than the second linear portion 404. A proximal end 406 of the limb 400 extends away from a lower end of the first linear portion 402 in a substantially perpendicular orientation relative to the first linear portion 402.

As shown in FIG. 2, the offset portion 146 is engaged with both the first linear portion 145 and the second linear portion 148 and extends between the first linear portion 145 and the second linear portion 148. The offset portion 146 is also angled with respect to both the first linear portion 145 and the second linear portion 148. As shown in FIG. 2, the offset portion 146 extends away from the weapon receiving area 115 of the weapon holder 100 at a lower end (e.g., proximal end, first end, etc.) of the offset portion 146 and back toward the weapon receiving area 115 at an upper end (e.g., a distal end, second end, etc.) of the offset portion 146. In the embodiment of FIG. 2, the offset portion 146 includes an arcuate extension 150 that bows (e.g., curves) away from the weapon receiving area 115. However, it should be understood that the shape of the offset portion 146 may be different in other embodiments. For example, the offset portion may include multiple substantially linear sections including a first section extending away from the first linear portion 145 at an angle with respect to the first linear portion (e.g., away from the weapon receiving area 115), and a second section extending away from the first section, at an angle with respect to the first section, back toward the gun receiving area. The first section and the second section may together define a substantially "V" shaped section that bows away from the weapon receiving area 115 at a central position along the "V" shaped section. In other embodiments, the offset portion 146 may include additional sections. In the embodiment of FIG. 2, the arcuate extension 150 has an approximately constant radius of curvature. In other embodiments, the curvature may vary along a length of the arcuate extension 150 (e.g., the arcuate extension may be substantially "U" shaped, etc.).

As shown in FIG. 2, the second linear portion 148 of the limb 106 is angled (e.g., non-parallel) with respect to the first linear portion 145. The second linear portion 148 may be angled away from the weapon receiving area 115. Among other benefits, angling the second linear portion 148 away from the weapon receiving area 115 allows a user to adjust the orientation of the weapon when placed into the weapon holder. For example, the user may move the fore end support 108 upward along the second linear portion 148 (e.g., toward a free, outer end of the second linear portion 148) to tip the fore end of the weapon (e.g., barrel) toward the blind, or vice versa to tip the fore end of the weapon upward and away from the blind. The angle of the second linear portion 148 with respect to the first linear portion 145 may be different in various embodiments.

As shown in FIG. 2, the fore end support 108 is coupled to a distal end 152 of the limb 106 (e.g., to the second linear portion 148) and is configured to support a fore end of the weapon (e.g., a forestock, barrel, etc.) within the weapon holder. The fore end support 108 may be movably coupled to the limb 106, for example, by engaging the fore end support 108 with one of a plurality of notches 154 along the limb 106.

Figure 11:
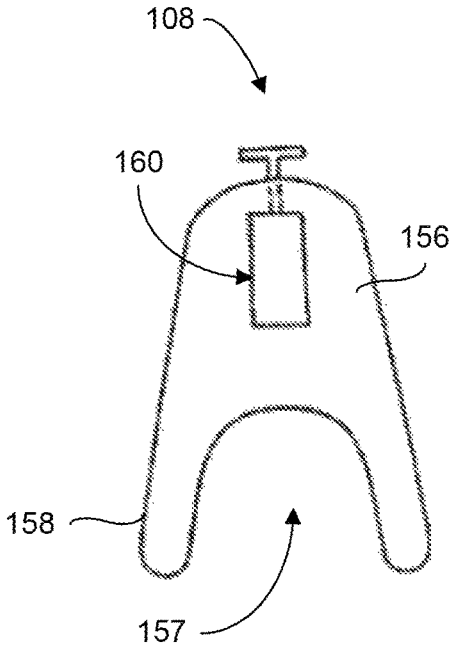
FIG. 11 is a top view of a fore end support for a weapon holder, according to an illustrative embodiment.

FIG. 11 shows a top view of the fore end support 108. The fore end support 108 includes a main body 156 and a pair of prongs 158 (e.g., tabs, fork shaped extension, extension pieces, etc.) extending away from the main body 156 and defining a substantially fork-shaped (e.g., "U" shaped, "Y" shaped, etc.) opening 157 therebetween. The opening 157 may be sized to receive a forestock and/or barrel of a weapon therein. As shown in FIG. 11, the fore end support 108 also includes a through-hole opening 160 extending through the main body 156 that is shaped complementary with a cross-sectional shape of the limb 106. As shown in FIG. 2, the limb 106 is inserted through the through-hole opening 160 and is slidably engaged with the fore end support 108. The fore end support 108 may also include a fastener extending through the main body 156 and into the through-hole opening 160 to secure a position of the fore end support 108 along the limb 106. In other embodiments, another form of connector (e.g., clips, etc.) may be used to secure the fore end support 108 in position along the limb 106.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

Other embodiments are set forth in the following claims.

What is claimed is:

1. A weapon holder, comprising:

a stock support defining a recessed area sized to receive a stock of a weapon therein;

a limb having a proximal end that is pivotally coupled to a first end of the stock support and extending away from the stock support at an angle relative to the stock support, the stock support and the limb together defining a weapon receiving area, the limb comprising an offset portion that extends away from the weapon receiving area, the recessed area disposed on an upper side of the stock support and facing toward the weapon receiving area;

a limb adjustment system configured to secure the limb in multiple angular positions relative to the stock support;

a fore end support coupled to a distal end of the limb; and a mount coupled to the stock support and configured to couple the stock support to a structure.

2. The weapon holder of claim 1, wherein the limb adjustment system is configured to adjust an angular position of the limb relative to the stock support.

3. The weapon holder of claim 1, wherein the stock support includes a base and two substantially parallel walls extending axially away from an upper side of the base, wherein the recessed area includes a gap formed between the two substantially parallel walls.

4. The weapon holder of claim 3, wherein a first wall of the two substantially parallel walls is moveably coupled to the base.

5. The weapon holder of claim 4, wherein the first wall is slidably engaged with the base, wherein the first wall is structured to move in a direction that is substantially perpendicular to a second wall of the two substantially parallel walls.

6. The weapon holder of claim 1, wherein the stock support further defines a slot extending inward from the first end of the stock support, and wherein a proximal end of the limb is disposed within the slot.

7. The weapon holder of claim 1, wherein the fore end support is moveably coupled to the limb, and wherein the fore end support defines a fork shaped extension sized to receive a forestock of the weapon or a barrel of the weapon therein.

8. The weapon holder of claim 1, wherein the mount extends away from the stock support at an oblique angle.

9. The weapon holder of claim 1, wherein the offset portion includes an arcuate extension that bows away from the weapon receiving area.

10. A weapon holder, comprising:

a stock support defining a recessed area sized to receive a stock of a weapon therein;

a limb having a proximal end that is pivotally coupled to a first end of the stock support and extending away from the stock support at an angle relative to the stock support, the limb comprising a first linear portion and an arcuate extension engaged with and extending away from the first linear portion, the recessed area disposed on an disposed on an upper side of the stock support and facing toward an area in which a weapon is received;

a limb adjustment system configured to secure the limb in multiple angular positions relative to the stock support;

a fore end support coupled to a distal end of the limb; and a mount coupled to the stock support and configured to couple the stock support to a structure.

11. The weapon holder of claim 10, wherein the limb further comprises a second linear portion, wherein the arcuate extension engaged with and extends between the first linear portion and the second linear portion.

12. The weapon holder of claim 11, wherein the first linear portion is angled with respect to the second linear portion.

13. The weapon holder of claim 10, wherein the first linear portion of the limb is rotatably coupled to the first end of the stock support.

14. The weapon holder of claim 1, wherein the stock support includes a base and two substantially parallel walls extending axially away from an upper side of the base, wherein the recessed area includes a gap formed between the two substantially parallel walls.

15. The weapon holder of claim 14, wherein a first wall of the two substantially parallel walls is moveably coupled to the base.

16. A blind, comprising:

a frame; and a weapon holder, comprising:

a stock support defining a recessed area sized to receive a stock of a weapon therein;

a limb having a proximal end that is pivotally coupled to a first end of the stock support and extending away from the stock support at an angle relative to the stock support, the stock support and the limb together defining a weapon receiving area, the limb comprising an offset portion that extends away from the weapon receiving area, the recessed area disposed on an upper side of the stock support and facing toward the weapon receiving area;

a limb adjustment system configured to secure the limb in multiple angular positions relative to the stock support;

a fore end support coupled to a distal end of the limb; and a mount coupled to the stock support and configured to couple the stock support to the frame.

17. The blind of claim 16, further comprising a wherein the mount that detachably couples the weapon holder to the blind, and wherein the mount extends away from the stock support at an oblique angle relative to the stock support.

18. The blind of claim 16, wherein the offset portion includes an arcuate extension that bows away from the weapon receiving area.

* * * * *